United States Patent [19]

Sovak et al.

[11] Patent Number: 5,056,395

[45] Date of Patent: Oct. 15, 1991

[54] CUTTER LINK FOR A MOTORIZED SAW CHAIN

[75] Inventors: Milos Sovak, Rancho Santa Fe; Robert A. Rauch, Poway, both of Calif.

[73] Assignee: Sovac Corporation, Las Vegas, Nev.

[21] Appl. No.: 469,150

[22] Filed: Jan. 24, 1990

[51] Int. Cl.[5] ..... B27B 33/14

[52] U.S. Cl. ..... 83/830; 83/834

[58] Field of Search ..... 83/830, 832, 833, 834, 83/849, 850, 835, 839

[56] References Cited

U.S. PATENT DOCUMENTS

| | | | |
|---|---|---|---|
| 2,746,494 | 5/1956 | Cox | 83/834 X |
| 2,798,517 | 7/1957 | Carney | 143/135 |
| 2,862,533 | 12/1958 | Mall | 143/135 |
| 2,976,900 | 3/1961 | Mills | 143/135 |
| 2,994,350 | 8/1961 | Lundberg | 143/148 |
| 3,292,675 | 12/1966 | Bullard | 143/135 |
| 4,211,136 | 7/1980 | Geurian | 83/830 |
| 4,604,932 | 8/1986 | Doiron | 83/830 |
| 4,606,253 | 8/1986 | Weigel | 83/835 X |
| 4,813,323 | 3/1989 | Harfst | 83/834 X |
| 4,841,825 | 6/1989 | Martin | 83/833 |
| 4,911,050 | 3/1990 | Nitschmann | 83/834 |

*Primary Examiner*—Frank T. Yost
*Assistant Examiner*—Kenneth E. Peterson
*Attorney, Agent, or Firm*—Steven F. Caserza; Steven F. Caserza

[57] ABSTRACT

A cutter link for a chain saw chain containing a conical raker spaced forward of a round cutter face. The raker protects most of the cutter face from sudden impact and, together with the cutting and rake angles of the cutter face, provides for a filing rather than a chiseling action by the cutter link. Saw chains incorporating the novel cutter link are impact and wear resistant.

11 Claims, 2 Drawing Sheets

FIG. 1
(PRIOR ART)
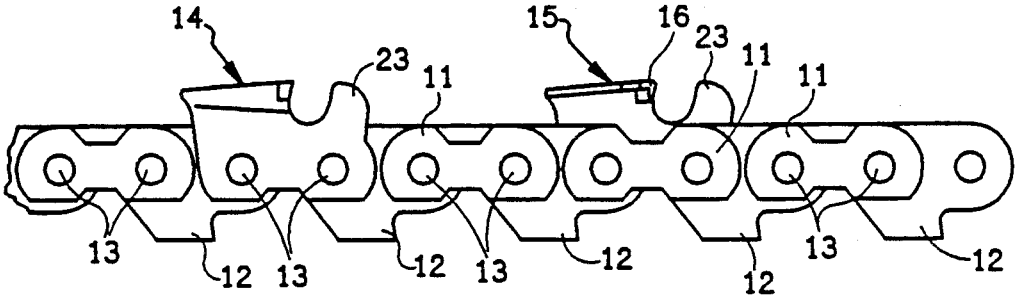
FIG. 2
(PRIOR ART)
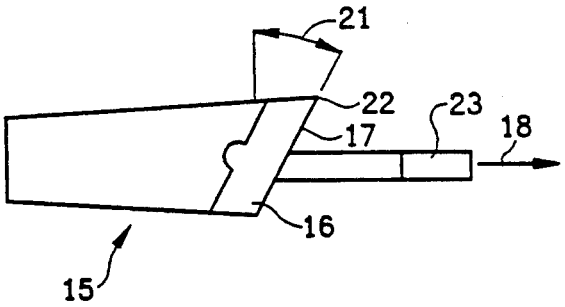
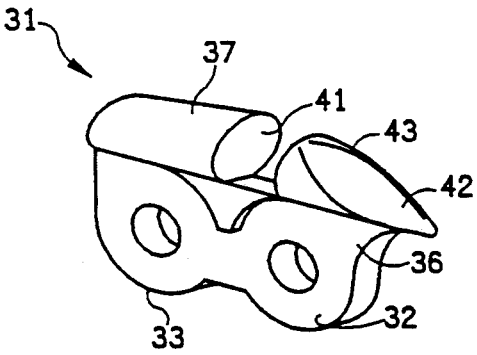
FIG. 3
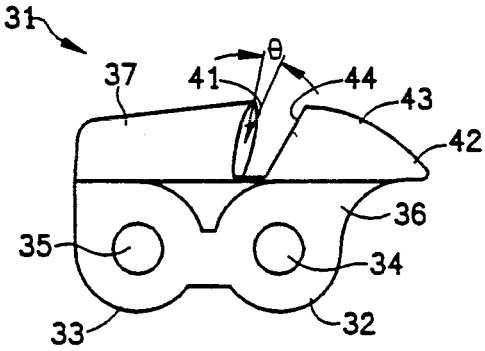
FIG. 4
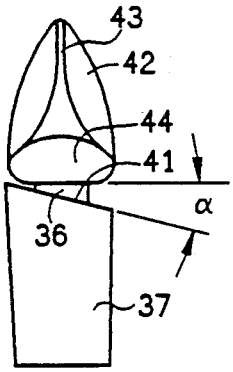
FIG. 5
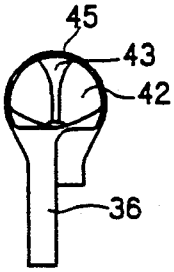
FIG. 6

CUTTER LINK FOR A MOTORIZED SAW CHAIN

FIELD OF THE INVENTION

This invention relates generally to chain saws, and more particularly to a saw chain cutter design which permits cutting a wide variety of materials while reducing dulling and breakage.

BACKGROUND OF THE INVENTION

Chain saws have been available for several decades. The chains used in chain saws commonly include drive links which engage into a power sprocket, connecting links and cutter elements. Such saw chains have been primarily intended for cutting wood. It has been found, however, that chain saws can be used to cut many different substances in addition to wood. Materials which can be cut by chain saw means include pumice stone, brick, tile, asbestos cement board, stucco, pipe and frame house and roof structures, which include shingles of a variety of materials including nails, joists, hangers and gravel and stone on top of built-up roofs. Firefighters have to use chain saws for cutting house structures on an emergency basis.

An extensive amount of prior art describes various chains developed for many cutting purposes. The known prior art traces attempts to develop a cutter more resistant to blunting and shock destruction than the conventional stamped-out steel cutter commonly used by the wood industry. A number of inventions relate to the shape of the cutting element and also to the use of hard metal alloy inserts, such as carbide compositions attached to steel supports. The prior art generally shows permanent attachments, that is, connecting of a hard metal insert to a body element by braising or soldering, for example. This type of structure is shown in U.S. Pat. Nos. 3,292,675, 2,976,900, 2,862,533, 2,798,517 and 4,606,253. U.S. Pat. Nos. 2,746,494 and 2,994,350 describe hard metal cutting inserts which are removable from the cutter body. The known prior art is primarily concerned with cutters having cutting edges which are rectangular or L-shaped, and which, due to the rapid movement of the chain, act as chisels, chipping away the material.

No prior art teaches the concept of effectively protecting the entire scope of the cutting edges from the effects of sudden impacts of hard material. Only U.S. Pat. Nos. 3,292,675 and 4,606,253 acknowledge or describe an attempt to remedy the impact problem. The '253 patent concerns a chain using a carbide composition insert supported by a steel element having two parallel flanks and made from a single piece of bent steel of relatively low hardness, intended to withstand the impact shock without detaching the cutting insert. This design, however, does not protect the carbide insert from frontal impact. The softness of the steel from which the chain links are manufactured causes rapid lengthening of the chain during cutting, which in turn may cause the chain to disengage itself from the leading groove of the saw bar or the sprocket or both.

The '675 patent claims a chain adequate for cutting through the mixed materials. It concerns an L-shaped cutter element of carbide with the cutting edge only partially mating with a notch in an L-shaped body of the cutting link.

SUMMARY OF THE INVENTION

Broadly speaking, this invention involves a new cutter element for chains which move rapidly and unidirectionally for the purpose of cutting through various materials. Such chains are predominantly, but not exclusively, used as cutting devices in power chain saws and the like.

A primary objective of this invention is a novel cutter link and cutter element to be incorporated with a chain which cuts rapidly through various materials of different hardness, is resistant to dulling and, more importantly, is able to withstand shock when, in a relatively soft material such as wood, a hard substance such as metal or mineral is encountered during cutting. This need is especially evident in applications such as cutting rapidly through various inhomogenous debris, such as encountered in natural catastrophe containment, for example, home fire, military use and in cutting through timber containing rock or sand. This objective is accomplished by the novel shape and design of the cutter element, providing long lasting sharpness and resistance to impact. One advantage resulting from this novel structure is that the cutting elements in the chain act more as files than as chisels.

The cutter of this invention can readily be incorporated as a component into the construction of existing conventional saw chains. The cutter is provided with a cutting edge being the circumference of a round or a semilunar plate which can be an integral part of the cutter, or be made from a hard metal firmly attached to the support body. The cutting face is effectively protected against frontal impact by a conical raker placed in front of the face's entire operative circumference. Unlike the prior art which generally describes cutter faces with cutting edges of rectangular shapes, this invention provides for a round face with its cutting edge being approximately the entire operative circumference of the face's frontal aspect.

The cutting element may be an integral portion of the body of the cutter chain link. Alternatively, the cutting element may be an insert secured to the body by appropriate means.

BRIEF DESCRIPTION OF THE DRAWING

The objects, advantages and features of the invention will be more clearly perceived from the following detailed description, when read in conjunction with the accompanying drawing, in which:

FIG. 1 shows a section of saw chain of the prior art;

FIG. 2 is an enlarged top view of the cutting link of the prior art device;

FIG. 3 is an enlarged perspective view of a saw chain cutting link constructed in accordance with the invention;

FIG. 4 is a side view of the link of FIG. 3;

FIG. 5 is a top view of the link of FIG. 3;

FIG. 6 is an end view of the link of FIG. 3;

DESCRIPTION OF THE PREFERRED EMBODIMENTS

Figure 7:
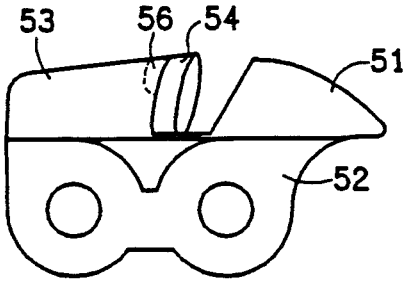
FIG. 7 is a side view similar to FIG. 4 of an alternative embodiment cutting link.
Figure 8:
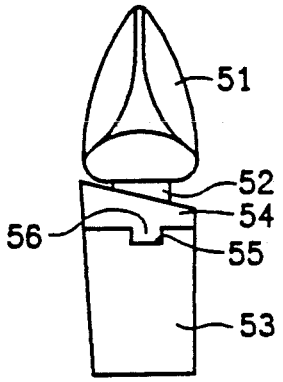
FIG. 8 is a top view of the cutting link of FIG. 7.

With reference now to the drawing, and more particularly to FIGS. 1 and 2, there is shown a segment of saw chain of the prior art. This cutting chain is intended to be used for cutting hard type materials such as brick, tile, and asbestos cement board, and mixed material items such as frame house structures and roof structures, without requiring the cutting elements to be touched up or sharpened on a very frequent basis. It is intended to withstand severe impacts without separating the cutting element from the body or cutting link.

The chain of FIG. 1 is comprised of three different elements, a multiplicity of which are connected together to form the continuous chain. Each of these elements is connected together by specific types of rivets, sometimes referred to as pintles, which allow one element to pivot with respect to the element to which it is coupled. Connecting side links 11 interconnect sprocket drive lugs 12 by means of pintles 13. Normally two connecting links are required for each connection of two drive lugs, one on each side. Alternating positions of the connecting links on the chain include cutter links 14 and 15 replacing one of connecting links 11. These cutter links are positioned on alternating sides of the chain as shown in FIG. 1. For example, cutter link 14 is shown on the upward side of the chain in the plane of the paper and cutter link 15 is shown on the lower side of the chain. This alternating arrangement is normal in saw chains, much like a typical saw of any type which has alternating teeth set in opposite directions with respect to the center line of the movement direction of the teeth. Pintles 13 are also used for connecting cutter links 14 and 15 to drive lugs 12 in conjunction with one of the connecting links.

Cutter link 15 is shown in FIG. 2 having cutting element or tip 16 having face 17 offset from a perpendicular to the line of travel 18 by an angle indicated by reference normal 21. This results in a sharp leading point 22. Preceding the cutting element as it passes through the material being cut is depth gauge 23 spaced forwardly of the cutting edge. The purpose of the depth gage is to limit the depth of bite for the cutting tips as they engage the material being cut. Note that the cutting tip of the prior art acts as a chisel, removing chunks of material as it passes through the kerf which the saw creates.

One embodiment of the cutting tip of the invention is shown in FIGS. 3–6. Base 36 of cutter link 31 is formed substantially the same as the equivalent prior art devices. Lobes 32 and 33 are made to accommodate openings 34 and 35 through which the pintles pass to connect the cutter link to the drive lugs of the chain, in conjunction with connecting links. The cutter link is provided with a hard steel body comprised of base 36 on top of which is cutting element 37 having cutting face 41 of circular or semilunar shape. On the forward top part of the cutter link, aligned with the longitudinal axis of cutting element 37, is conical raker 42 having a crest 43 at its superior aspect and a circular profile 44 at its posterior aspect.

Cutting face 41 has a cutting angle $\theta$ (FIG. 4) typically ranging between 3° and 20°, and a rake angle $\alpha$ (FIG. 5), typically ranging between 10° and 45°. For cutting hard materials such as would be expected on a gravel covered asphalt roof, and when expecting sudden impact in the cut material such as nails, the cutting angle will preferably be in the range of 8° to 15° and the rake angle will be in the range of 15° to 25°. When cutting predominantly homogenous and softer materials, such as wood, the preferred cutting angle will be in the range of 10° to 20° and the rake angle would preferably be about 30° to 4520 . The cutting angle $\theta$ is the angle between face 41 and the vertical plane (FIG. 4). The rake angle $\alpha$ is the angle between face angle 41 and the transverse plane (FIG. 5).

None of the prior art devices provides for effective protection of the entire cutting face and cutting edge against impact. This is understandable, since the previously described cutting elements generally are either L-shaped, rectangular, or nearly rectangular. The prior art only describes "depth gauges", that is, teeth-shaped promontories protruding upwardly from the frontal part of the cutter base, generally having the same thickness as the base, and mating with the cutting face, although minimally (see FIG. 2).

The cutting element of this invention is distinctly different from the prior art. It is especially designed to be a round face. The face's cutting edge can be either a full circle or a substantial part of a circle. The diameter of the cutter face is generally in the range of 0.12 to 0.38 inch. Nearly the entire face 41 is solidly protected by the anteriorly placed raker. The shape of raker face 44 roughly matches cutter face 41 except the average diameter of face 44 is somewhat smaller to allow for exposure of cutting edge 45 as shown in FIG. 6. Typically, the difference in the average diameter will vary from 0.0005 to 0.050 inch and will most typically be about 0.015 inch for cutting hard material and for use in situations when sudden impact is expected. The diametrical difference will typically be about 0.040 inch when homogenous, soft materials such as wood is being cut. Different cutter link configurations are provided for the expected use of the saw chain. When viewed in the lateral plane, the raker has a bullet-shape with crest 43 allowing for the pre-scoring of the cut material. The gradual increase of the raker in its anterior/posterior aspect serves to deflect any suddenly encountered inhomogenous substances. The difference in diameter with respect to the cutter face enables the saw chain to function as a file rather than as a group of chisels.

The embodiment of FIGS. 3–6 is a hard steel body 37 which has an integral cutting face 41, which is protected by solid, bullet-shaped raker 42. An alternative embodiment is shown in FIGS. 7-14 9, having an identical raker 51 on an identical base 52 but with a two-piece cutter portion, body 53 and cutter element 54. The cutter element is secured by welding or brazing or other suitable means to body 53. Notch 55 in the body receives tab 56 on the cutter element for proper mating alignment. Cutter element 54 is preferably made of a carbide composition which holds a cutting edge very well. Otherwise this embodiment has the same shape and functions in the same way as the embodiment of FIGS. 3–6.

Figure 10:
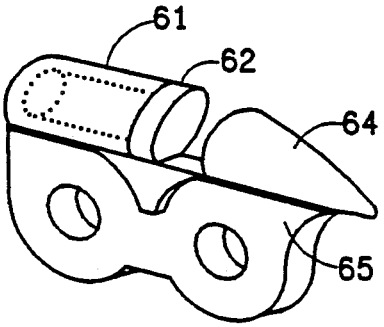
FIG. 10 is a perspective view similar to FIG. 3 of another embodiment of the cutting link of the invention.
Figure 9:
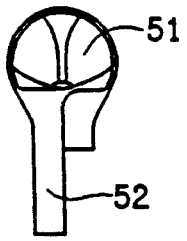
FIG. 9 is an end view of the cutting link of FIG. 7.
Figure 11:
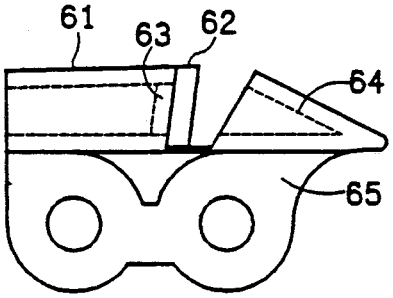
FIG. 11 is a side view of the cutting link of FIG. 10.
Figure 12:
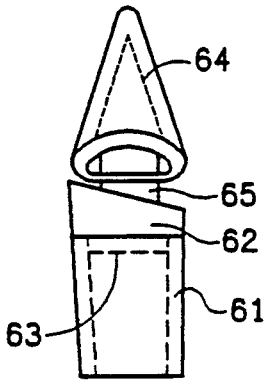
FIG. 12 is a top view of the cutting link of FIG. 10.

Another embodiment of the cutter link is shown in FIGS. 10–12. Body 61 is formed from a stamped plate formed through a series of dies into a cylinder. This cylinder receives cutter element 62 on the forward end. The cutter element is preferably formed with a rearward projection 63 which provides mating alignment. That projection may be cylindrical or have any desired shape with at least three side points which engage or lie closely adjacent the inside surface of cylindrical body 61. These components may be secured together by soldering, brazing, welding, or by other suitable means.

Raker 64 is similarly formed into a cone from a flat stamped plate by a series of dies. Both the body or the raker, or both, are spot welded, laser welded, or otherwise suitably secured to base 65. Note that the body and raker of this embodiment may not be completely rounded but may be formed with a gap the width of base 65 with the elongated edges welded to the base.

The body and raker of the other embodiments could be made integral with their respective bases, or they could be separate elements welded to the base.

Actual testing has been conducted to determine how the cutter of this invention performs compared with other cutters in identical chains. The other cutters advertise the ability to effectively cut through the various materials discussed above.

This cutter was incorporated into a ⅜" chain base and tested in a double blind experiment against commercially available carbide-tip chains sold under the names Repco 404 and Stihl Duro, all mounted on identically performing motor saws of the same type and origin. The test consisted of four consequential cuts to a total of a 60 linear feet, through a prop simulating a wood/tar/felt paper with gravel and/or corrugated metal roof construction of the type prevalent in the United States. This was immediately followed by perpendicular cuts through standard construction nails ("16 penny") of about 3 millimeters diameter and inserted longitudinally in wooden beams. The results are shown in Table 1.

TABLE 1

| Chain | Saw Speed RPM Start | Saw Speed Max % Decrease | Cutter Average Temperature °C. After 60 Feet Cut | Duration of 60 Feet Cut (min/sec) | Elements of Damage After 60 Feet and 4 Nails: Cutter | Dulling | Carbide Chip | Loss | Elements of Damage After Additional 14 Nails: Cutter | Dulling | Carbide Chip | Loss |
|---|---|---|---|---|---|---|---|---|---|---|---|---|
| STIHL DURO | 12,500 | 39.02 | 153 | 1.54 | / | yes | / | / | 11 | yes | 7 | 19* |
| REPCO 404 | 12,500 | 40.08 | 162.5 | 1.50 | 5 | no | / | 17 | not applicable due to previous damage | | | |
| INVENTION | 12,500 | 41.06 | 167.5 | 1.52 | / | no | / | / | 1 | yes | 1 | 4 |

*Could not be tested further due to the extensive damage

In conclusion, while there were no significant differences in the saw speed, cutter temperature or speed of cutting, only the chain with cutters made in accordance with this invention remained operational at the conclusion of the test.

In view of the above description, it is likely that modifications and improvements will occur to those skilled in the art which are within the scope of the accompanying claims.

What is claimed is:

1. A cutter link for a saw chain, comprising:

a base member having a top section, and having a bottom section having holes therethrough for connecting links together by means of pintles, said base member having a forwardly facing end and a rearwardly facing end;

a raker formed within said top section at said forwardly facing end of said base member within said top section and having a rearwardly facing end which is generally circular in cross section; and a body formed within said top section rearwardly of said raker and spaced therefrom, said body including a forward end having a cutting edge facing said rearwardly facing end of said raker, said cutting edge being of the same shape as said rearward facing end of said raker and having a diameter greater than the diameter of said rearward facing end of said raker.

2. The cutter link recited in claim 1, wherein said cutting face has a generally round periphery which serves as said cutting face.

3. The cutter link recited in claim 2, wherein said body is formed of a hard steel.

4. The cutter link recited in claim 1, wherein said raker is generally conically shaped having a longitudinal axis substantially non-perpendicular to the length of said body, and having a first end and a second end larger than said first end, said first end extending forwardly on said base element.

5. The cutter link recited in claim 1, wherein said body is comprised of:

a support member secured to said base, said support member having a forward end; and a cutter element secured to said forward end of said support member, said cutter element having said cutting edge.

6. The cutter link recited in claim 5, wherein said cutter element is formed of a hard metal.

7. The cutter link recited in claim 1, wherein said cutting edge has a diameter larger than the diameter of said rearward facing end of said raker by approximately 0.005 to 0.050 inch.

8. The cutter link recited in claim 7, wherein said diameter difference is approximately 0.015 inch when hard materials are to be cut.

9. The cutter link recited in claim 7, wherein said diameter difference is approximately 0.040 inch when wood or other relatively soft materials are to be cut.

10. The cutter link recited in claim 1, wherein said raker is formed from a plate rolled into a conical shape and said body is formed from a plate rolled into a cylindrical shape, said raker and said body being secured to said base, said cutting edge being formed on a cutter element secured to the forward end of said body.

11. A cutter link for a saw chain comprising:

a base member having means to enable links to be connected together as a part of the saw chain, said base member having a forwardly facing end and a rearwardly facing end;

a generally conically shaped raker formed at the forward end on top of said base member and having a rearwardly facing end which is generally circular in cross section and a forwardly facing generally pointed end; and a body formed rearwardly, aligned with, and spaced from said raker on top of said base member, said body including a forward end having a cutting edge of the same shape as said rearwardly facing end of said raker and having a diameter greater than the diameter of said rearwardly facing end of said raker, said cutting edge being for the most part shielded by said raker from material being encountered by said cutter link as it moves to cut the material.

* * * * *